US008544430B2

(12) United States Patent
Elendt et al.

(10) Patent No.: US 8,544,430 B2
(45) Date of Patent: Oct. 1, 2013

(54) VALVE DRIVE OF AN INTERNAL COMBUSTION ENGINE

(75) Inventors: Harald Elendt, Altendorf (DE); Andreas Nendel, Hessdorf (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 111 days.

(21) Appl. No.: 13/258,604

(22) PCT Filed: May 26, 2010

(86) PCT No.: PCT/EP2010/057259

§ 371 (c)(1),
(2), (4) Date: Sep. 22, 2011

(87) PCT Pub. No.: WO2010/149454

PCT Pub. Date: Dec. 29, 2010

(65) Prior Publication Data

US 2012/0006292 A1 Jan. 12, 2012

(30) Foreign Application Priority Data

Jun. 25, 2009 (DE) ..... 10 2009 030 373

(51) Int. Cl.
*F01L 1/34* (2006.01)

(52) U.S. Cl.
USPC ..... 123/90.16; 123/90.6; 74/559

(58) Field of Classification Search
USPC ..... 123/90.16, 90.6; 74/559, 569
See application file for complete search history.

(56) References Cited

U.S. PATENT DOCUMENTS 5,704,315 A * 1/1998 Tsuchida et al. ..... 123/90.16

FOREIGN PATENT DOCUMENTS

| | | | |
|---|---|---|---|
| DE | 195 19 048 | A1 | 11/1996 |
| DE | 101 48 179 | A1 | 4/2003 |
| DE | 10 2007 010 148 | A1 | 9/2008 |
| DE | 10 2007 010 149 | A1 | 9/2008 |
| DE | 10 20007 010 150 | A1 | 9/2008 |
| DE | 10 2007 027 979 | A1 | 1/2009 |
| DE | 10 2007 051 739 | A1 | 5/2009 |
| DE | 10 2009 009 080 | A1 | 8/2010 |
| GB | 2 130 672 | A | 6/1984 |
| JP | 2000 073731 | A | 3/2000 |
| WO | 2008107106 | | 9/2008 |
| WO | 2009/056427 | A1 | 5/2009 |

* cited by examiner

*Primary Examiner* — Zelalem Eshete
(74) *Attorney, Agent, or Firm* — Volpe and Koenig, P.C.

(57) ABSTRACT

A valve drive of an internal combustion engine with variable-lift gas exchange valve actuation. The valve drive has a camshaft with a support shaft and a cam piece arranged on the support shaft for conjoint rotation therewith and to be movable between axial positions. The cam piece has two cam groups of directly adjacent cams with different elevations and, on the end side, the cam piece has an axial slotted guide into which can be coupled an actuating element. The cam piece has a bearing journal which runs between the cam groups and rotatably mounted in a camshaft bearing point arranged in a positionally fixed manner in the engine. Here, the diameter of the bearing journal is larger than the envelope circle diameter of a cam closest to the bearing journal with the cam and camshaft bearing point overlapping axially in an axial position of the cam piece.

7 Claims, 3 Drawing Sheets

VALVE DRIVE OF AN INTERNAL COMBUSTION ENGINE

CROSS-REFERENCE TO RELATED APPLICATIONS

This application is a 371 of PCT/EP2010/057259 filed May 26, 2010, which in turn claims the priority of DE 10 2009 030 371.1 filed Jun. 25, 2009. The priority of both applications is hereby claimed and both applications are incorporated by reference herein.

FIELD OF THE INVENTION

The invention relates to a valve drive of an internal combustion engine with variable-lift gas exchange valve actuation.

BACKGROUND OF THE INVENTION

As is known, the variability in the lift of a valve drive of this kind is created by virtue of the fact that the different elevations of the cams are each transmitted selectively to the gas exchange valve by means of a cam follower, which is conventionally of rigid design. To allow the respective elevation to be activated in accordance with the operating point, the cam piece is arranged on a support shaft for conjoint rotation therewith but so as to be movable, and is moved backward and forward between the axial positions in accordance with the number of cams.

A valve drive of the type in question with a multi-valve system and camshaft bearings that are central with respect to the cylinders is disclosed by DE 101 48 179 A1, for example. With just two cams per cam group, however, the variability in the lift of this valve drive is restricted to two stages.

Valve drives with greater variability, having three cams per cam group, are proposed in DE 10 2007 010 148 A1, DE 10 2007 010 149 A1, DE 10 2007 010 150 A1 and DE 10 2007 027 979 A1. One significant common feature of these valve drives is that the camshaft bearing is a structural unit which is supported radially in the internal combustion engine, surrounds the bearing journal between the cam groups and, as a departure from the "traditional," i.e. rigid, camshaft hearing assembly, is moved axially on the support shaft together with the cam piece. Despite the fact that, with three cams, the cam groups are relatively wide, together with the fact that the camshaft bearing assembly is central with respect to the cylinder and furthermore that the spacing between the gas exchange valves is small, a bearing design of this kind allows a sufficiently broad bearing journal support width that is independent of the axial positions of the cam piece.

The disadvantage is the associated outlay on production and assembly, especially because of the additionally introduced tolerances with respect to coaxial alignment at the movable camshaft bearing since the total tolerances in respect of the permissible radial runout of the camshaft have to be maintained within unchanged narrow limits.

SUMMARY OF THE INVENTION

The present invention relates to a valve drive that, despite retaining a simple bearing design which can be produced economically, has a high potential for more than two-stage, in particular three-stage, variability in the lift.

More specifically, the present invention is directed to a valve drive which comprises a camshaft with a support shaft and a cam piece that is arranged on the support shaft for conjoint rotation therewith and so as to be movable between axial positions. The cam piece has two cam groups of directly adjacent cams with different elevations. On the end side of the cam piece, the cam piece has an axial slotted guide into which can be coupled an actuating element for moving the cam piece on the support shaft. The cam piece has a bearing journal which runs between the cam groups and which is rotatably mounted in a shaft bearing which is arranged in a positionally fixed manner in the internal combustion engine. The diameter of the bearing journal should be larger than the envelope circle diameter of a cam closest to the bearing journal, with cam and the camshaft bearing overlap axially in one of the axial positions of the cam piece. In other words, provision is made to fundamentally retain the traditionally rigid bearing concept for the camshaft, but the enlargement of the diameters of the bearing journal and the camshaft bearing allows one cam and preferably all the cams to enter the camshaft bearing. The axial freedom of movement thereby provided for one or both cam groups relative to the camshaft bearing on the one hand forms the basis for wide-ranging use of such valve drives, even with camshaft bearing assemblies where there is relatively little valve clearance with respect to the camshaft bearing and, on the other hand, increases the potential for three-stage or multi-stage variability in the lift.

As a development of the invention, a split camshaft bearing with a lower half shell extending on the same side as the gas exchange valves and with an upper half shell formed by a bearing cap is provided. In this arrangement, the bearing width of the upper half shell should be significantly larger than the hearing width of the lower half shell. This design embodiment of the invention takes into account the fact that it is principally the upper part of the camshaft bearing, that facing away from the gas exchange valves, which is subjected to load by reason of the valve spring and inertia forces and which can nevertheless be widened with a view to adequately firm support of the bearing journal in all axial positions since the axial freedom of movement of the cam followers actuating the gas exchange valves relative to the camshaft bearing need only be provided with respect to the lower half shell. As an alternative, however, it is also possible to provide tunnel-type support for the camshaft in an undivided camshaft bearing, optionally with variable bearing width over the circumference thereof.

For the preferred case of three-stage variability in the lift with three directly adjacent cams per cam group, just one bidirectionally acting axial slotted guide is furthermore provided, into which two actuating elements can be alternately coupled. In the case of a bidirectional axial slotted guide, the cam tracks, which run in both the axial directions, are combined spatially and either run axially adjacent or radially in series with respect to one another. In contrast, the cam piece according to DE 101 48 179 A1, which was cited at the outset, has two unidirectional axial slotted guides, which run at the end sections thereof and each of which has just one cam track. Bidirectional axial slotted guides with axially intersecting cam tracks are proposed in DE 10 2007 051 739 A1, and bidirectional axial slotted guides with cam tracks running radially in series are proposed in DE 10 2009 009 080 A1, which is not a prior publication.

DE 10 2007 010 149 A1, which was cited at the outset, discloses a likewise bidirectional axial slotted guide with cam tracks that merge into one another axially but this requires the existence of three actuating elements that can be coupled in alternately. The comparatively small axial installation space requirement of the bidirectional axial slotted guides mentioned leads to cam pieces of short construction axially and, especially in the case of wide cam groups with three or more cams, makes it possible to maintain the required axial spacing between the cam pieces, which are moved along the support shaft in succession in accordance with the ignition sequence of the internal combustion engine.

Moreover, one of the three cams should furthermore be without an elevation. This cam is what is referred to as a base circle cam, which leads to shutdown of the associated gas exchange valve owing to its purely cylindrical form.

The camshaft bearing preferably forms a hydrodynamic plain bearing with the bearing journal, (although it is also possible to provide rolling contact bearings as an alternative). For this purpose, the camshaft bearing is penetrated by a hydraulic medium channel, the outlet of which into the plain hearing is provided with a narrowed channel portion, such that the outlet is covered by the bearing journal in all axial positions of the cam piece. In other words, this prevents a merely partial overlap between the bearing journal and the hydraulic medium channel in the outer axial positions of the cam piece, with a correspondingly high loss of hydraulic medium.

In terms of design, the narrowed channel portion can be a passage in an insert which is arranged in a recess in the camshaft hearing and is part of the plain bearing surface. The insert can be designed as a cylindrical disk fixed in the recess, and the passage can be designed as an elongate hole extending substantially orthogonally with respect to the axis of rotation of the camshaft.

As far as is possible and expedient, the abovementioned features and embodiments of the invention should also be capable of being combined as required.

BRIEF DESCRIPTION OF THE DRAWINGS

Further features of the invention will emerge from the following description and from the drawings, in which an illustrative embodiment of the invention is depicted in part in simplified form. In the drawings.

DETAILED DESCRIPTION OF THE INVENTION

Figure 1:
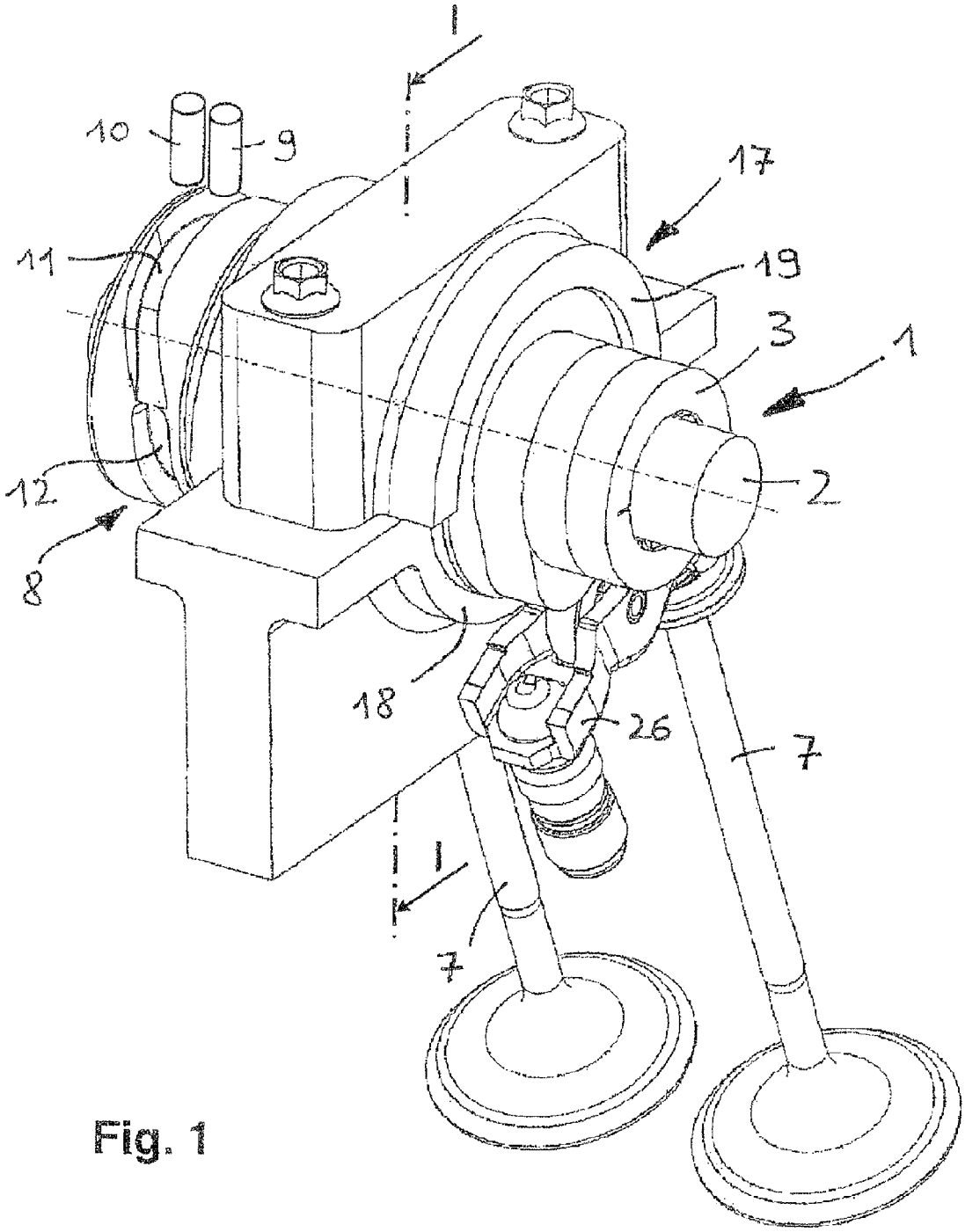
FIG. 1 shows a portion of a valve drive of an internal combustion engine, with the camshaft bearing assembly shown in perspective.
Figure 2:
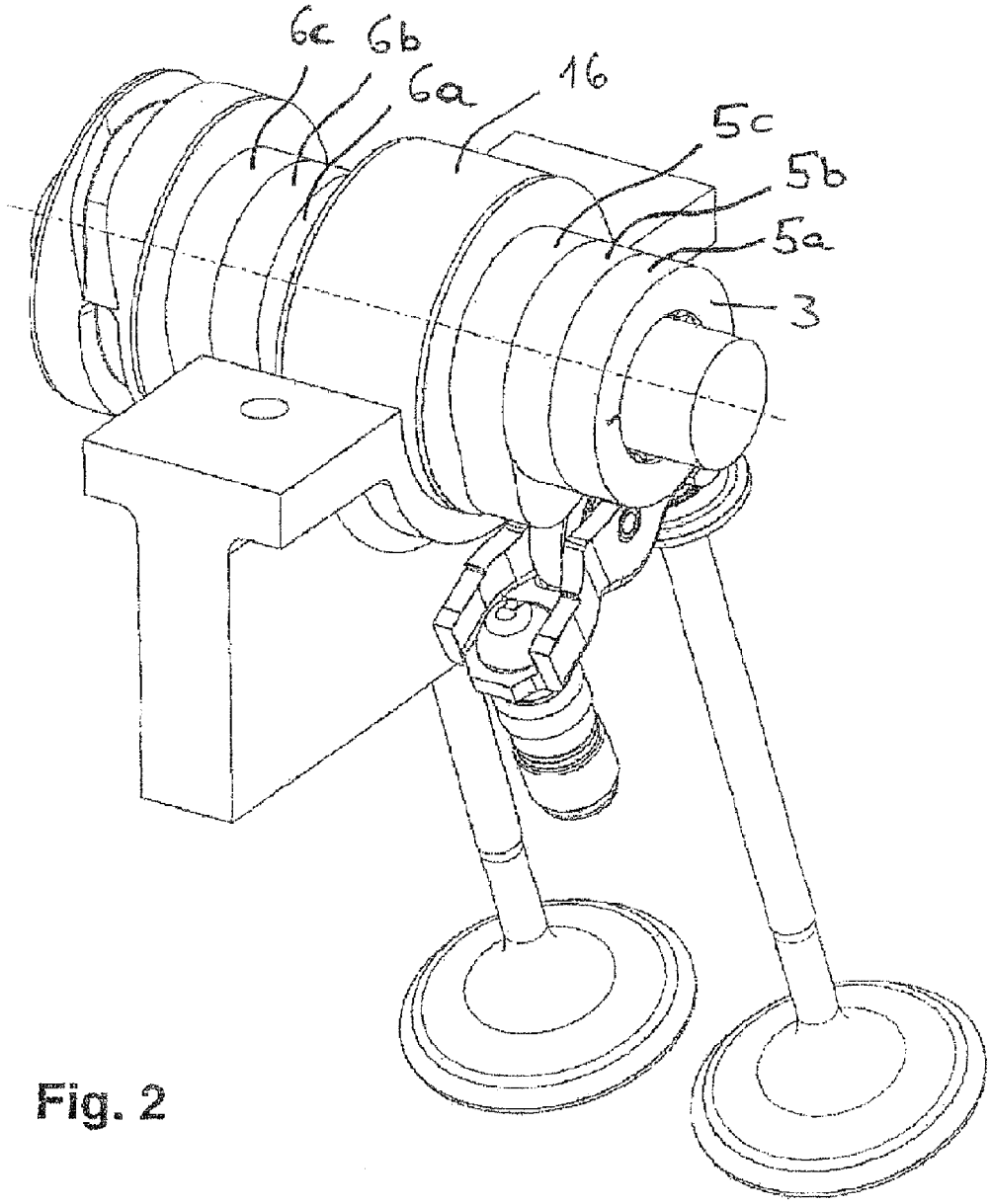
FIG. 2 shows the portion from FIG. 1 without the bearing cap.
Figure 3:
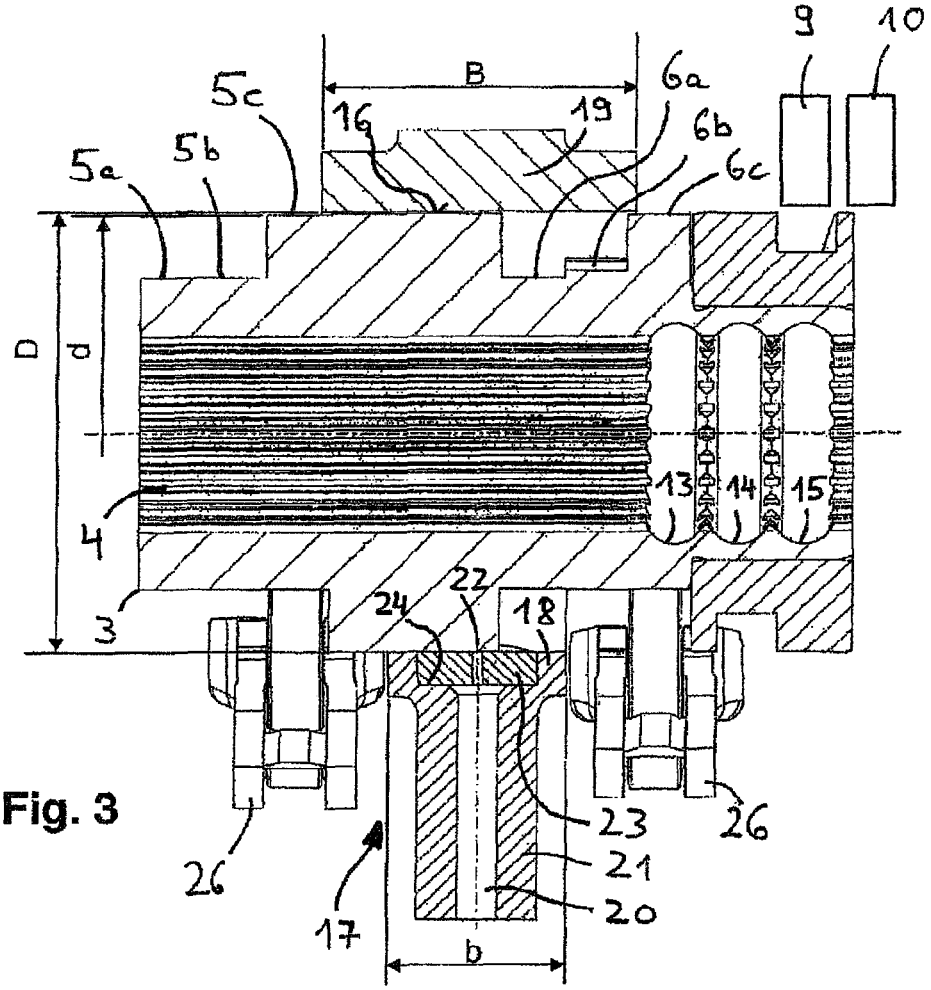
FIG. 3 shows the portion illustrated in FIG. 1 in longitudinal section (section I-I in FIG. 1, without the support shaft)

FIGS. 1 to 3 disclose a portion, essential for an understanding of the invention, of a valve drive of an internal combustion engine with a multi-valve system and variable-lift gas exchange valve actuation. A central component for the operation of the valve drive is a camshaft 1, which comprises a support shaft 2 and—in accordance with the number of cylinders of the internal combustion engine—cam pieces 3 which are arranged on said support shaft for conjoint rotation therewith and so as to be movable between three axial positions. For the purpose of axial movement, the support shaft 2 is provided with external longitudinal splines, and each cam piece 3 is provided with matching internal longitudinal splines. The splines, of which the internal longitudinal splines 4 can be seen in FIG. 3, are known per se.

To produce the variability in the lift of the valve drive, each cam piece 3 has two cam groups, each with three directly adjacent cams 5*a-c* and 6*a-c*, which have different elevations and the same base circle radius. These elevations are transmitted selectively, i.e. in accordance with the instantaneous axial position of the cam piece 3, to the gas exchange valves 7 by means of finger followers 26. The term "different elevations" refers to differences in the respective amounts of cam lift and/or differences between the valve timings of the cams 5*a-c* and 6*a-c*. Thus cams 5*a* and 6*a* are "base-circle cams," which are without elevations and each lead to the shutdown of the gas exchange valve 7.

Movement of the cam piece 3 between the axial positions thereof takes place outside the elevations during the common base circle phase of the cams 5*a-c* and 6*a-c*. The actuator system required for this purpose is known in principle from DE 101 48 179 A1, for example, which was cited at the outset, and comprises a groove-shaped axial slotted guide 8 on the cam piece 3 and two actuating elements 9 and 10 in the form of cylindrical actuator pins (shown here in greatly simplified form), which are arranged in the internal combustion engine in such a way as to be axially positionally fixed relative to the camshaft 1 but to allow radial movement toward the camshaft 1 and can be coupled into the axial slotted guide 8 for the purpose of moving the cam piece 3. In the present case, the cam piece has just one axial slotted guide, arranged on the end side, but this is designed to act bidirectionally with two radially successive and axially opposed cam tracks 11 and 12. Alternate coupling in of the two actuating elements 9, 10, which are spaced apart axially by one cam width, into the cam tracks 11, 12 allows successive movement of the cam piece 3 into the three axial positions thereof. For details of such an axial slotted guide 8, reference should be made to DE 10 2009 009 080 A1, which was cited at the outset.

The cam piece 3 is secured in the respective axial position thereof against uncontrolled movement by a retention device. The retention device, which is known per se and is not illustrated specifically here, comprises a spring-loaded pressure piece, which is mounted in a transverse hole in the support shaft 2 and—depending on the axial position of the cam piece 3—latches into one of three encircling grooves 13, 14 and 15 on the inner circumference of the cam piece (see FIG. 3).

To provide the camshaft 1 with radial support in the internal combustion engine, the cam piece 3 is provided between the cam groups with a bearing journal 16, which is rotatably mounted in a camshaft bearing 17 arranged in a positionally fixed manner and centrally with respect to the cylinder in the internal combustion engine. The split camshaft bearing 17 is composed of a lower half shell 18, which extends on the same side as the gas exchange valves 7, and an upper half shell 19, which is formed by a screwed-on bearing cap. The finger followers 26 positioned on each side of the camshaft bearing 17 actuate the two inlet valves 7 of a cylinder.

As can be seen in the illustration with the bearing cap 19 removed in FIG. 2 and as is apparent especially from the dimensioned illustration in FIG. 3, the diameter D of the bearing journal 16 is larger, according to the invention, than the largest envelope circle diameter d of all the cams 5*a-c* and 6*a-c*. This design embodiment of the camshaft bearing assembly makes it possible not only for the cams 5*c* and 6*a* closest to the bearing journal 16 but all the cams 5*a-c* and 6*a-c* to enter the camshaft hearing 17 in the two outer axial positions of the cam piece 3. Despite the short distance between the finger followers 26 and the camshaft bearing 17, it is possible in this way to achieve the three-stage variability in the lift of the valve drive, corresponding to a total axial movement of the cam piece 3 by three times the width of a cam.

FIG. 3 shows, for the outer left-hand axial position of the cam piece 3 in said figure, how the cams 5*a-c* and 6*a-c* overlap axially with the camshaft bearing 17. In this instantaneous axial position, the cams 5*c* and 6*c* having the largest elevations are in engagement with the finger followers 26. The base circle cam 6*a* has entered fully into the camshaft bearing 17, while, in the case of the cam 6*b*, this applies only in respect of the upper half shell 19 formed by the bearing cap, the bearing width B of which is significantly greater, in accordance with the loading, than the bearing width h of the lower half shell 18. In both outer axial positions of the cam piece 3, the cams 5*c* and 6*c* have a small axial overlap with the upper half shell 19.

With the camshaft bearing 17, the bearing journal 16 forms a hydrodynamic plain bearing. This is supplied by means of a hydraulic medium channel 20, which passes through the web 21 supporting the lower half shell 18 in the form of a hole and the outlet of which into the plain hearing is provided with a narrowed channel portion 22 in the direction of the axis of rotation of the camshaft. The narrowed channel portion 22 has the effect that the outlet of the hydraulic medium channel 20 is fully covered by the bearing journal 16, even in the two outer axial positions of the cam piece 3, thus preventing the formation of a hydraulic leakage flow directly into the unpressurized environment of the plain bearing.

Figure 4:
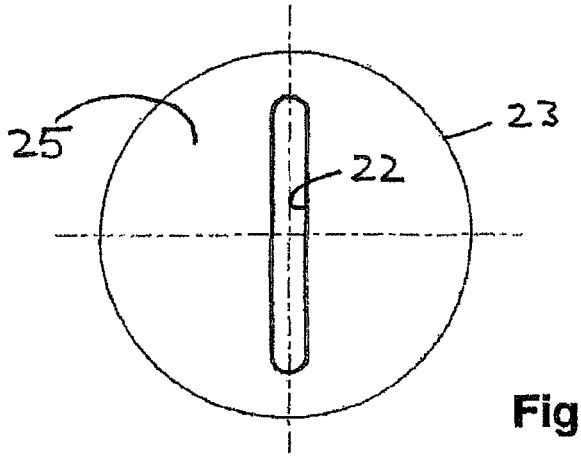
FIG. 4 shows an insert arranged in the camshaft bearing (hydrodynamic plain bearing) for the formation of a narrowed channel portion ahead of the plain bearing, as an enlarged detail.

The narrowed channel portion 22 is a passage in an insert 23 which is arranged in a recess 24 in the camshaft bearing 17 and forms part of the plain bearing surface. According to FIG. 4, the insert 23 is designed as a cylindrical disk which is pressed into the recess 24 in the form of a counterbore in the lower half shell 18 and is finish machined together with the camshaft bearing 17 with the bearing cap 19 screwed on. That face 25 of the disk 23 which faces away from the hole 20 is accordingly given a concave cylindrical shape. The passage 22 has the shape of an elongate hole extending orthogonally with respect to the axis of rotation of the camshaft, the width of which is significantly less and the length of which is significantly greater than the diameter of the hole 20. With a view to minimum restriction of the hydraulic medium flowing through it, its dimensions are furthermore configured in such a way that the elongate hole 22 and the hole 20 have cross-sectional areas of substantially the same size.

LIST OF REFERENCE SIGNS

1 Camshaft
2 Support Shaft
3 Cam Piece
4 Internal Longitudinal Splines
5 Cam Group with Cams 5*a-c*
6 Cam Group with Cams 6*a-c*
7 Gas Exchange Valve
8 Axial Slotted Guide
9 Actuating Element
10 Actuating Element
11 Cam Track
12 Cam Track
13 Encircling Groove
14 Encircling Groove
15 Encircling Groove
16 Bearing Journal
17 Camshaft Bearing
18 Lower Half Shell
19 Upper Half Shell/Bearing Cap
20 Hydraulic Medium Channel/Hole
21 Web
22 Narrowed Channel Portion/Passage
23 Insert/Disk
24 Recess
25 Face of the Disk
26 Finger Follower
D Diameter of the Bearing Journal
d Envelope Circle Diameter
B Bearing Width of the Upper Half Shell
b Bearing Width of the Lower Half Shell

The invention claimed is:

1. A valve drive of an internal combustion engine with variable-lift gas exchange valve actuation, comprising: a camshaft having a support shaft and a cam piece, which is arranged on the support shaft for conjoint rotation therewith and so as to be movable between axial positions, the cam piece having two cam groups of directly adjacent cams with different elevations and envelope circle diameters, on an end side, the cam piece having an axial slotted guide, and the cam piece having a bearing journal which has a diameter and runs between the cam groups; a camshaft bearing, which is arranged in a positionally fixed manner in the internal combustion engine and in which the bearing journal is rotatably mounted; and an actuating element, which can be arranged in the axial slotted guide and coupled to the axial slotted guide for moving the cam piece on the support shaft, wherein the diameter of the bearing journal is larger than one of the envelope circle diameters of one of the cams closest to the bearing journal, wherein the one of the cams and the camshaft bearing overlap axially in one of the axial positions of the cam piece, wherein the camshaft bearing forms a hydrodynamic plain bearing with the bearing journal and, the camshaft bearing has a hydraulic medium channel with an outlet that has a narrowed channel portion, such that the outlet is covered by the bearing journal in all axial positions of the cam piece.

2. The valve drive as claimed in claim 1, wherein the diameter of the bearing journal is larger than a largest envelope circle diameter of all of the cams of the cam piece.

3. The valve drive as claimed in claim 1, wherein the camshaft bearing is a split camshaft bearing having a lower half shell and an upper half shell, the lower half shell has a hearing width and extends on a same side as gas exchange valves and the upper half shell is formed by a hearing cap and has a width that is larger than the hearing width of the lower half shell.

4. The valve drive as claimed in claim 1, wherein there are two actuating elements and each cam group has three directly adjacent cams and only one bidirectionally acting axial slotted guide is provided, into which the two actuating elements can be alternately coupled.

5. The valve drive as claimed in claim 4, wherein one of the three directly adjacent cams does not have an elevation.

6. The valve drive as claimed in claim 1, further comprising an insert having a passage with the narrowed channel portion being the passage in the insert, and the camshaft bearing having a recess with the insert arranged in the recess in the camshaft bearing that is part of the plain bearing surface.

7. The valve drive as claimed in claim 6, wherein the insert is a cylindrical disk fixed in the recess, and the passage is an elongate hole extending substantially orthogonally with respect to an axis of rotation of the camshaft.

* * * * *